United States Patent [19]

Murry

[11] Patent Number: 4,506,890

[45] Date of Patent: Mar. 26, 1985

[54] ELECTRONIC DICE GAME

[76] Inventor: Edward J. Murry, 9223 W. 119th St., Palos Park, Ill. 60464

[21] Appl. No.: 458,549

[22] Filed: Jan. 17, 1983

[51] Int. Cl.[3] ..... A63F 9/04

[52] U.S. Cl. ..... 273/138 A; 273/85 CP

[58] Field of Search ..... 273/85 CP, 138 A

[56] References Cited

U.S. PATENT DOCUMENTS

| | | | |
|---|---|---|---|
| 3,592,473 | 7/1971 | Jernakoff et al. | 273/138 A |
| 3,659,853 | 5/1972 | Church | 273/138 A |
| 4,034,988 | 7/1977 | Goldner et al. | 273/138 A |
| 4,223,893 | 9/1980 | Shane et al. | 273/138 A |
| 4,244,578 | 1/1981 | Rosenzweig | 273/138 A |
| 4,314,336 | 2/1982 | Bernstein et al. | 273/85 CP |

FOREIGN PATENT DOCUMENTS

| | | | |
|---|---|---|---|
| 2709938 | 9/1978 | Fed. Rep. of Germany | 273/138 A |

OTHER PUBLICATIONS

I. J. Dilworth, "*Electronic Die*", Jan. 1978, Practical Electronics, pp. 340–344.

"*Take a Gamble: Double Die*", May 1979, Electronics Today International, pp. 26–29.

Don Lancaster, "*Spots Before Your Eyes*", 9/77, Popular Electronics, pp. 29–34.

*Primary Examiner*—Richard C. Pinkham

*Assistant Examiner*—Leo P. Picard

*Attorney, Agent, or Firm*—Hill, Van Santen, Steadman & Simpson

[57] ABSTRACT

An electronic dice game comprising a series of electronic circuits which are connected together such that various dice games can be played with an electronic display board wherein such games previously could only be played with cube-shaped dice and the present device provides games which are played in a realistic manner and allow roll counters with whole dice features and various game selections can be made.

The simulated faces of a plurality of die are displayed using seven PIP indicators for each die.

2 Claims, 15 Drawing Figures

Vcc
310
ROLL DICE
311
31
182
4066
DIE #22
DIE #21
TO RANDOM GENERATOR
CONTROLS SWITCHES
LOCK-OUT
181
4049
CONTROL SWITCHES
DIE #22
180
74LS74
74 74
DIE #21
41
RESET
32

4066
221
Vcc
ROLL COUNT
91
92
93
4017
10
13
14
8
16
15
220
RESET
555
222
Vcc
ROLL
31b
31

32
32b
Vcc

ELECTRONIC DICE GAME

BACKGROUND OF THE INVENTION

1. Field of the Invention

This invention relates in general to an electronic dice game and in particular presents a game and display wherein two or more dice can be observed by the players and solid state electronic circuitry is utilized.

2. Description of the Prior Art

Many complex electronic games have been created in different format and sizes from the hand-held home games to the heavier units used in arcades such as Pac-Man, Asteroids etc. Some of these electronic games have been based on previous mechanical games such as tennis, hockey or Ping Pong. Each of these electronic games have had features which make them appealing to various players. However, none of them have comprised a device that can be played between two or more players in bars, taverns, restaurants or other quiet places with ease, convenience and minimum disturbance of other customers.

SUMMARY OF THE INVENTION

It is an object of the present invention to provide an electronic dice game wherein a display means displays dice by generating PIPS in seven dot configuration with not more than six PIPS being generated at any one time so as to realistically represent the appearance of several dice rolling and then stopping on the face up presentation with from one to six PIPS on each die.

As few as two dice may be utilized or as many as ten. Various dice games such as Craps, Poker, Hi-Lo, Ship, Captain Crew or Liar's Dice and variations of such games may be played. Also, it is to be realized that the present invention allows other specific games other than these to be played by utilizing the circuitry of the apparatus. It is an object of the present invention to disclose the method whereby the dice are rolled, are counted and the count recorded and the PIPS are energized so as to display the rolled dice. Furthermore, the rolled dice can be either retained or again rolled as desired and the device can be reset for a new or next player.

Another object of the invention is to provide a gaming device which may be used in a convenient precise and adequate form so that it is useable in bars, taverns, restaurants and other quiet places where ordinary cube dice would be distractive and disruptive and would require complex equipment to utilize.

A still further object is to present a game device in which competition can be achieved with ease and precision for various desired games without argument or controversy.

Other objects, features and advantages of the invention comprising an all electronic dice game device will be readily apparent from the following description of certain preferred embodiments thereof taken in conjunction with the accompanying drawings although many variations and modifications such as substitution of a direct reading numeric output display of the numbers one to six for the PIPS can be utilized without departing from the spirit and scope of the novel concepts and ideas of the device and in which:

DESCRIPTION OF THE PREFERRED EMBODIMENTS

The present invention comprises a dice game which is capable of (1) providing similation of a regular dice cube bearing PIPS on it from one to six in number and (2) causing the display PIPS to change from one to six in a random and realistic manner which indicates to players that dice are being rolled.

Figure 1:
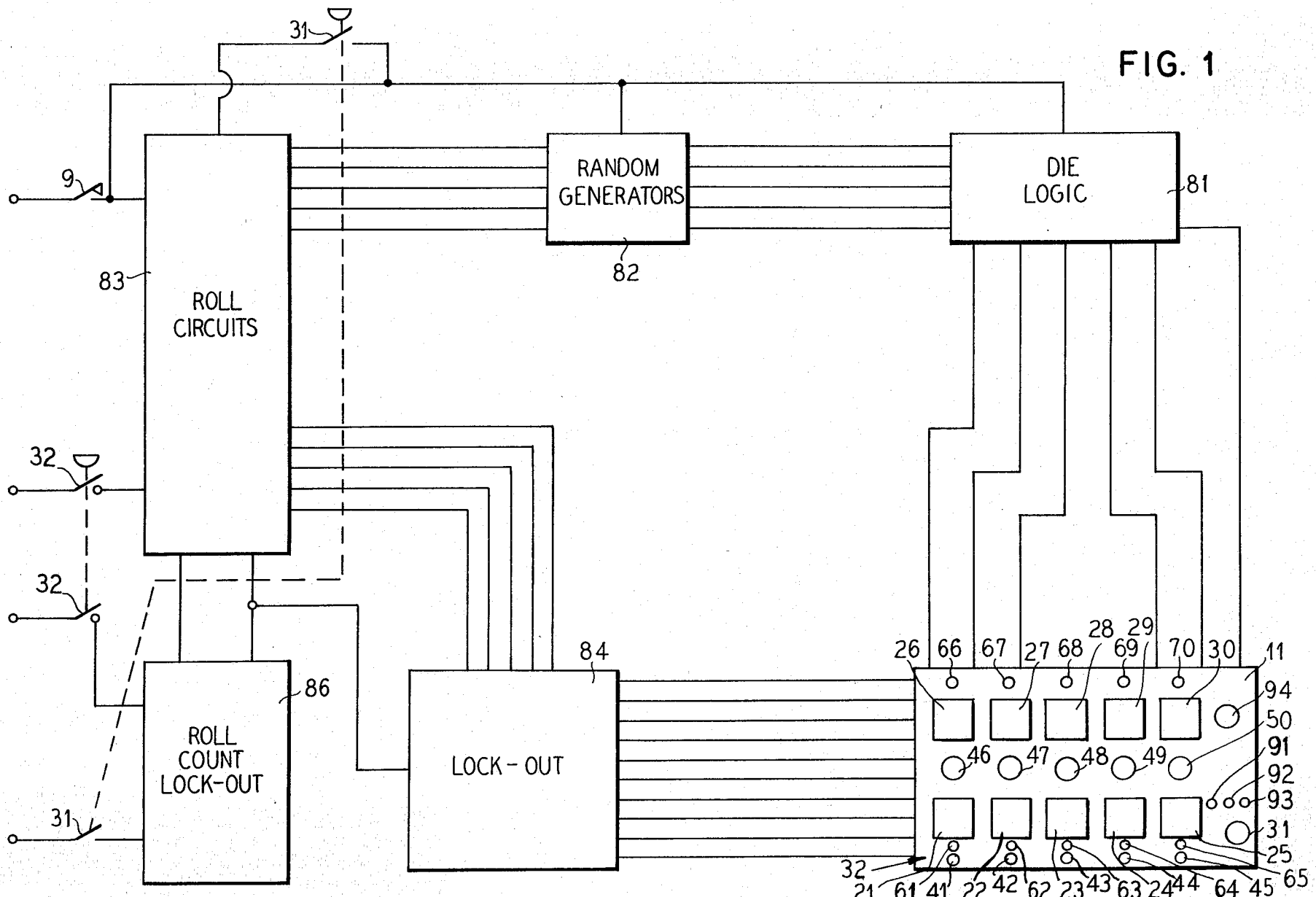
FIG. 1 is a block diagram illustrating the overall system interconnection.
Figure 2:
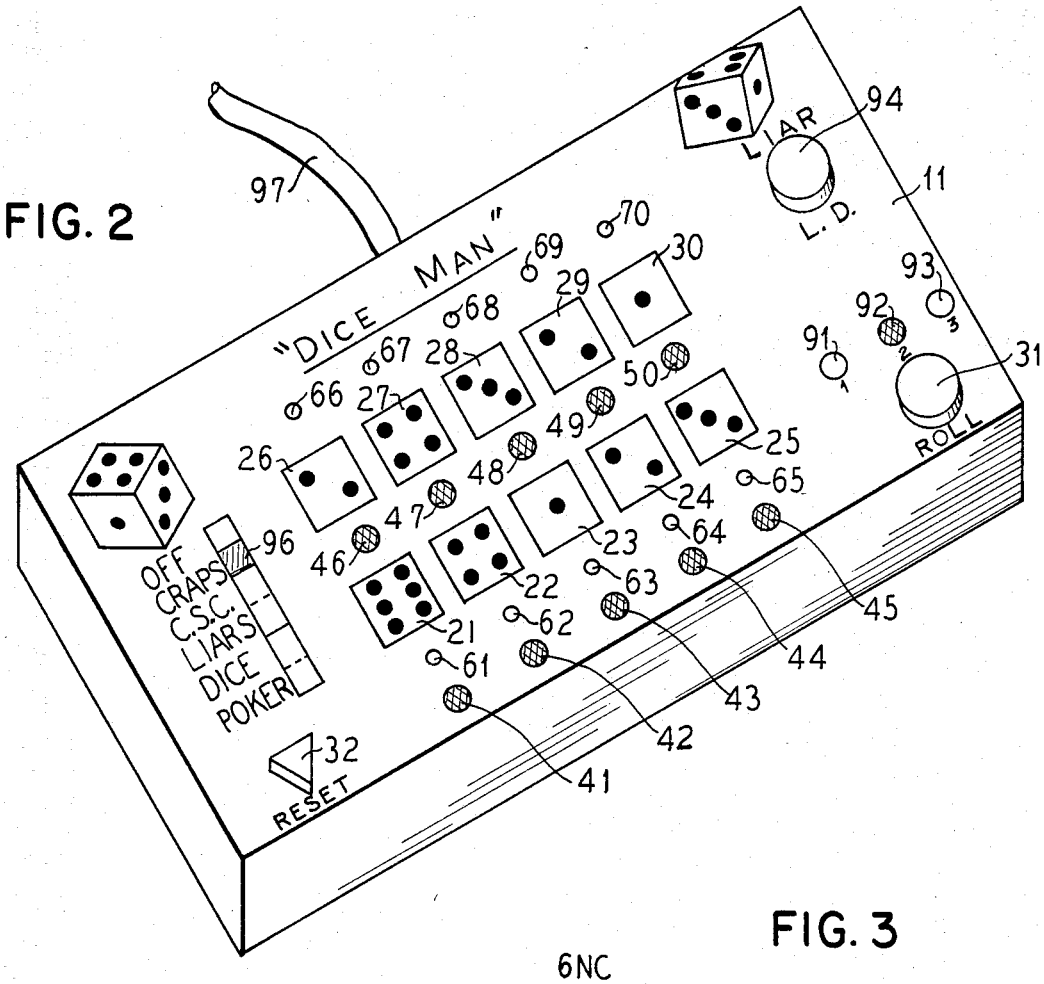
FIG. 2 is a perspective view illustrating the portable hand-held controlled device for use by an individual player.

This invention uses transistors and integrated circuits. It was determined that so as to make a realistic presentation of the dice that it would be necessary to illuminate seven PIPS rather than six since the one or ace must be in the center of the pseudo die to give a realistic appearance. The display determines what the entire logic package requires and the circuitry and design were arranged to give this desired display. FIG. 1 illustrates in block form the overall system and apparatus including the display and dice control cabinet 11 on the face which are mounted the dice display 21 through 30 with 5 in the lower row and 5 in the upper row. This unit is also shown in larger scale in FIG. 2. As shown in FIG. 2, each of the dice 21 through 30 are provided with seven PIPS which can be illuminated with light emitting diodes LED. A push button roll activator button 31 starts the dice to roll. Each of the dice has a lock out or hold switch 41 through 50 which will cause the dice to hold or retain its present indication during the next roll if such hold or lock out switch 41 through 50 associated with each of the dice 21 through 30 is depressed. Indicators such as LEDs 61 through 70 are mounted adjacent the dice 21 through 30.

A number of integrated circuits 81 cause the dice 21 through 30 to be illuminated in a random manner such that one or more of the seven PIPS are lighted. A number of random generators 82 supply inputs to the die logic circuit 81 and these random generators are activated by a series of ten roll circuits 83 which consists of integrated circuits. The roll switch 31 is shown in three places in FIG. 1 and is connected to the roll circuits 83 as well as the roll count lock out circuit 86. Lock out circuit 84 is connected to the circuits 83 and the console 11 and it prevents a specific die 21 through 30 which has been selected to be locked out or held from changing during the next roll. The roll/counter lock out 86 operates in a manner such as to permit 1, 2, 3 or more pressings of the roll switch 31 and no more and is preset by a maintenance man or at the factory.

Figure 3:
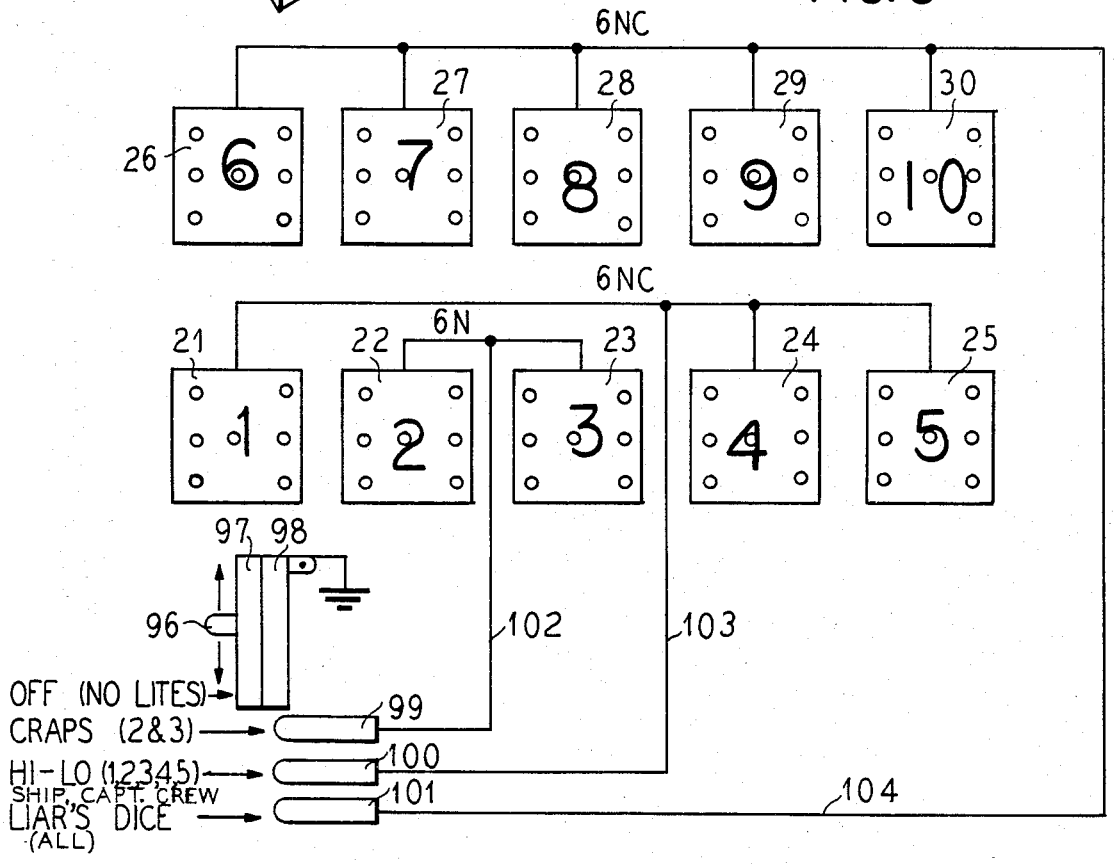
FIG. 3 is a schematic view illustrating how the dice are interconnected so that they can be used for various games which require either 2, 5 or 10 dice.

FIG. 2 is an enlarged detailed view of the hand held dice control display unit 11. It includes a special slide switch 96 which is also shown in FIG. 3 and is arranged so that it can activate the required number of dice needed for a specific game and it can select two, five or ten dice. As illustrated in FIG. 3, as the switch 96 is moved downwardly, its contact 97 continues to engage the grounded contact 98 and in the first position illustrated in FIG. 3 the switch 96 is off so that none of the dice are energized. When the switch is moved down to the first position so that contact 97 engages the contact 99 and the lead 102 connected so the dice 22 and 23 will be grounded through the contact 97 and 98 and the dices 22 and 23 will be energized. This position is used for the game of Craps, for example. If the contact 97 is moved down to the third position, the contact 97 will engage contacts 98, 99 and 100 and the leads 102 and 103 will be grounded so the five dice 21 through 25 will be energized. In the fourth position, the contact 96 will engage the contacts 98, 99, 100 and 101 and the leads 102, 103 and 104 will be grounded so all ten dice will be energized. A switch 94 turns on Lier's Dice and indicators 91, 92 and 93 respectively indicate the number of rolls as, for example that 1, 2 or 3 rolls have occurred. A reset switch 32 allows reset for certain games.

Figure 4:
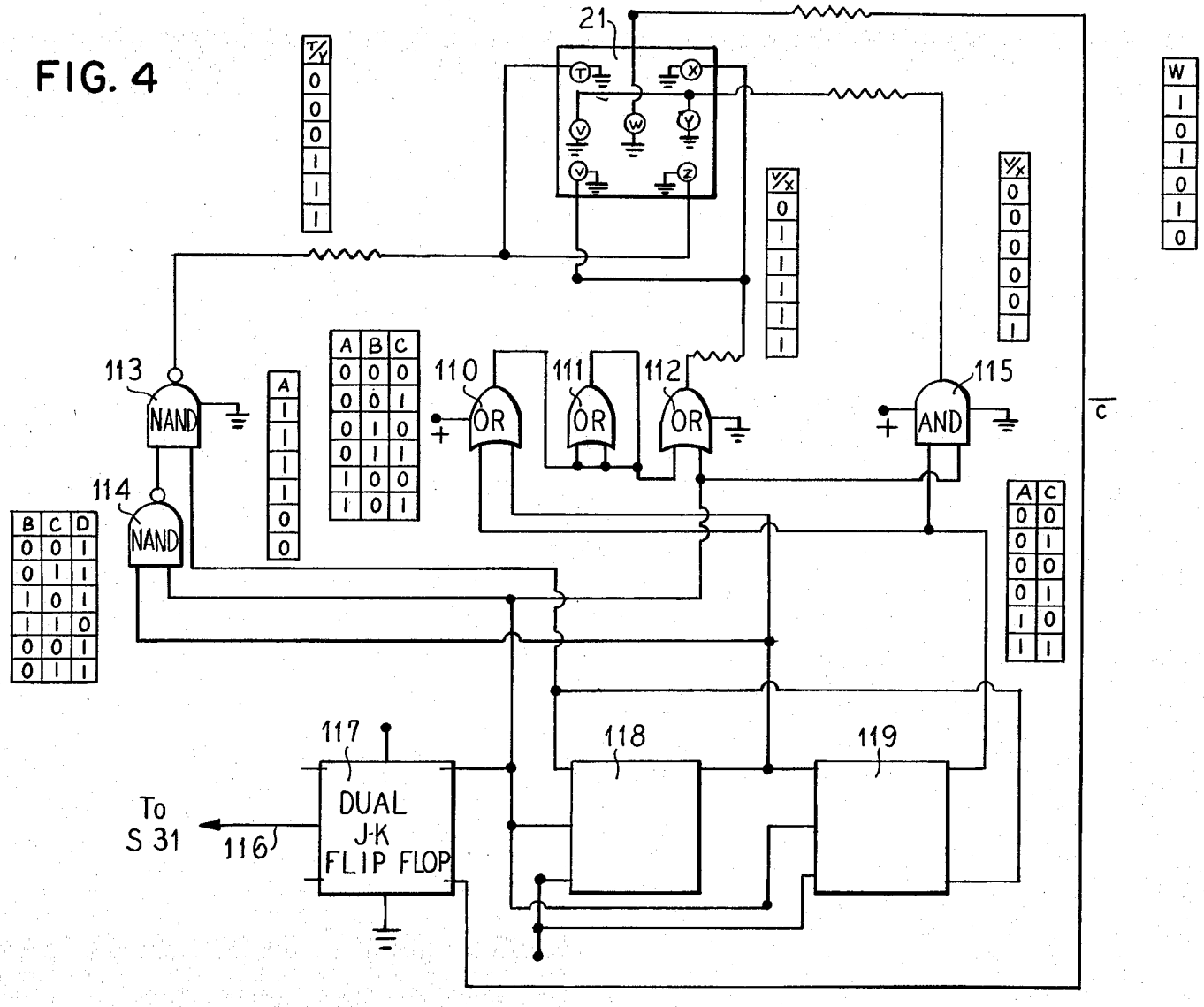
FIG. 4 is a schematic view which shows how one single die is controlled.

FIG. 4 illustrates the circuitry required for one single die. An integrated circuit type 7476 uses three sections of J-K flip-flop circuits 117, 118 and 119 which are connected as shown and are driven by a suitable clock pulse on lead 116 and are interconnected with three sections of OR gates 110, 111, 112 connected as shown. Two sections of NAND gates 113 and 114 which may be formed of a integrated circuit type 7400 are connected as shown and a one section AND gate 115 connected as shown are connected so as to drive the PIPS of the dice as, for example, the die 21. It is noted that each of the die has seven PIPS and all of the elements are clocked or pulsed by a series of randomly generated pulses arriving at lead 116 which is the clock input to a 7476 dual J-K flip-flop integrated circuit. Since there are ten dice which are to be driven and two sections of J-K flip-flop are obtainable in a single integrated circuit 15 model 7476s will be required to operate the entire ten dice. The PIPS on the dice 21 will be energized in rotation going through the complete cycle of six numbers one by one for as long as the pulses arrive from the random generators 82.

Figure 5B:
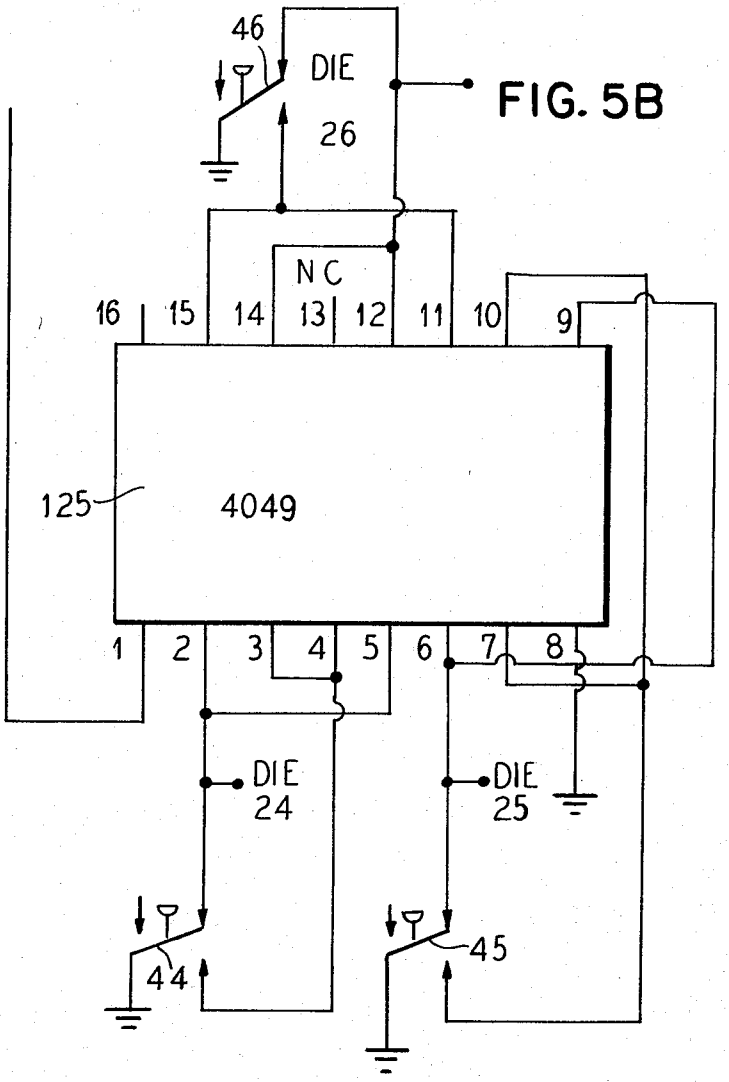
FIG. 5A and 5B illustrate a "stick circuit" used to lock out the dice once they have been rolled and selected.
Figure 5A:
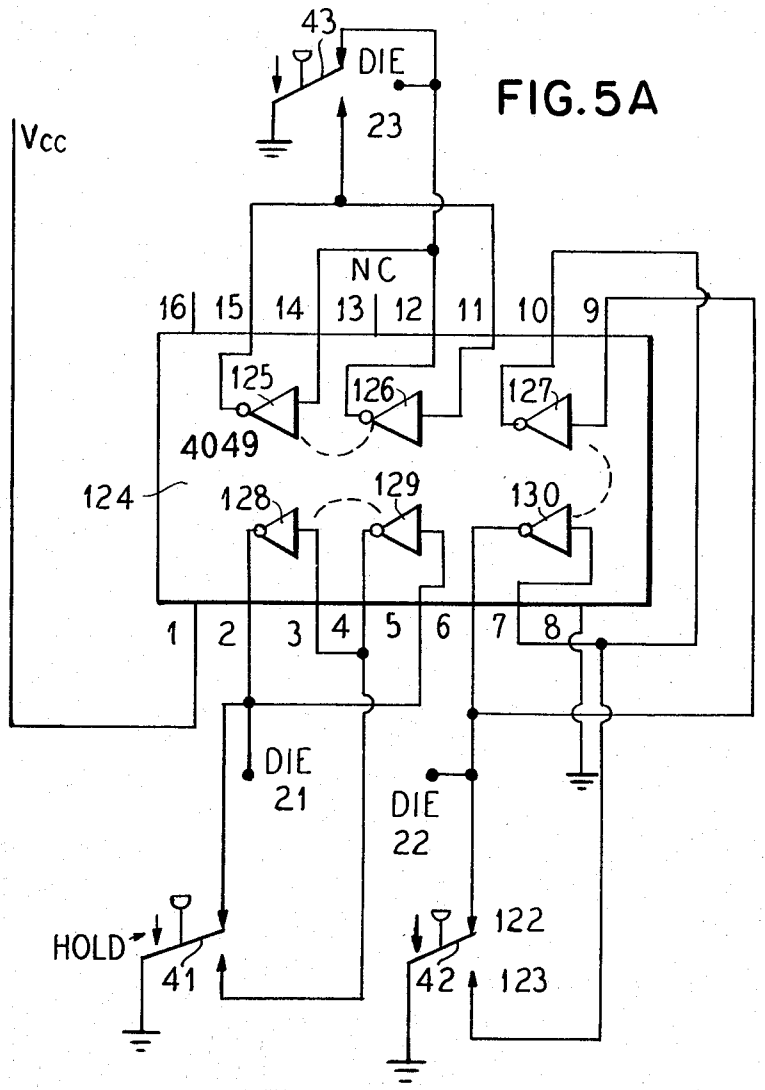

FIGS. 5A and 5B illustrate a bounce free (no squitter) switch 42 which is used to provide a single squitter-free pulse to the CLK circuitry of the roll control circuits after a choice of a number has been selected. The circuits consist of two sections of a 4049 Hex Inverter buffer 124 and 125. For ten bounce free activating switches 42 four integrated circuits type 4049 are required but four invertor segments per game will not be utilized. The switch 41 is for die number 21, the switch number 42 is for die number 22, switch number 43 is for die number 23, the switch 44 is for die number 24, the switch 45 is for die number 25, and the switch 46 is for die number 26. The gates 128 and 129 are connected to die 21. The gates 127 and 130 are connected to die 22, and the gates 123 and 126 are connected to the die 23, etc.

Figure 6A:
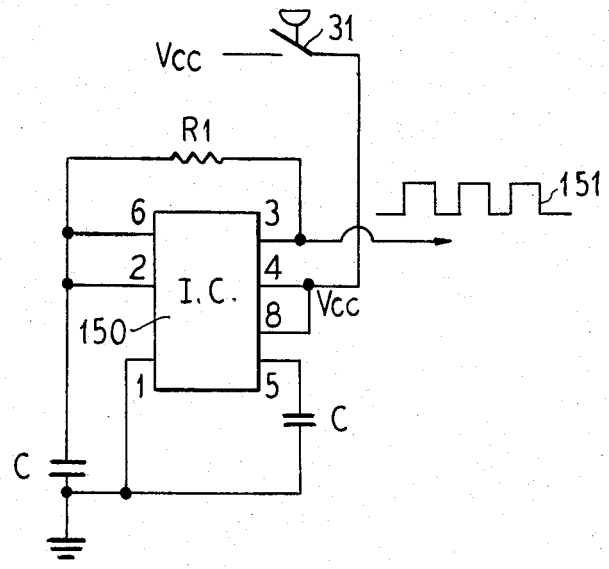
FIG. 6A illustrates a random generator circuit of the invention.

FIG. 6A illustrates the random number generator 150 which can be an integrated circuit type 555 and it produces a series of pulses 151 as long as the roll switch 31 supplies Vcc voltage to the 555 timers that are used. Resistor R1 connected between pins 3 and 6 on the integrated circuit 150 is used to provide a realistic appearance of the rolling dice on the seven PIPS of each die. It has been determined that values of 150,000 to 180,000 ohms for resistor R1 operates satisfactorily. If the value of this resistor is too large, then the LED PIPS will appear continuously to be lighted while if the value is too small the rate of roll of the dice will be slow and the die number can to some extent be controlled. The value for resistor R1 given above allows the dice to appear to roll and yet cannot be stopped on any one number.

Figure 6B:
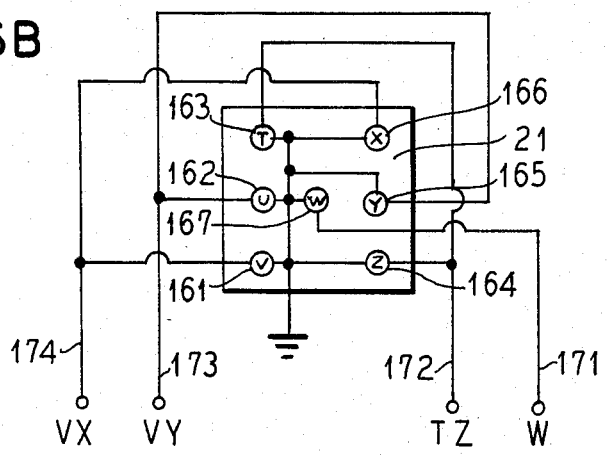
FIG. 6B is a circuit diagram illustrating how a single die is interconnected.

FIG. 6B shows the interconnections of the PIPS on the dice as, for example, the dice 21. The PIPS are lettered T, U, V, W, X, Y and Z and the leads 174, 173, 172, 171 are connected as shown. PIPS are also numbered 161 through 167 as shown. The PIP 167 (W) is used for rolling a one, a three or a five but is not used in 2, 4 or 6. The T Z PIPS are used for 2, 3, 4, 5 or 6. PIPS U and V are used solely for generating six and lead 174 is used in generating a six, a four and a five but is not used for generating a two or a three.

Figure 6C:
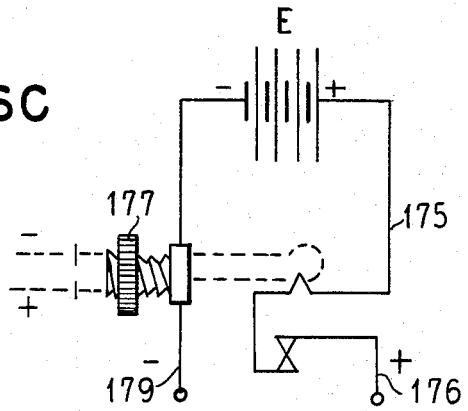
FIG. 6C is a schematic diagram illustrating the recharge circuit of the invention.

FIG. 6C illustrates an external charging circuit of conventional design which can be used when a battery operated unit is to be utilized which uses a battery E and has a negative terminal 179 and a positive terminal 176. When the battery E is to be charged a plug 177 is connected to the battery leads 175, 179 to charge it.

Figure 7:
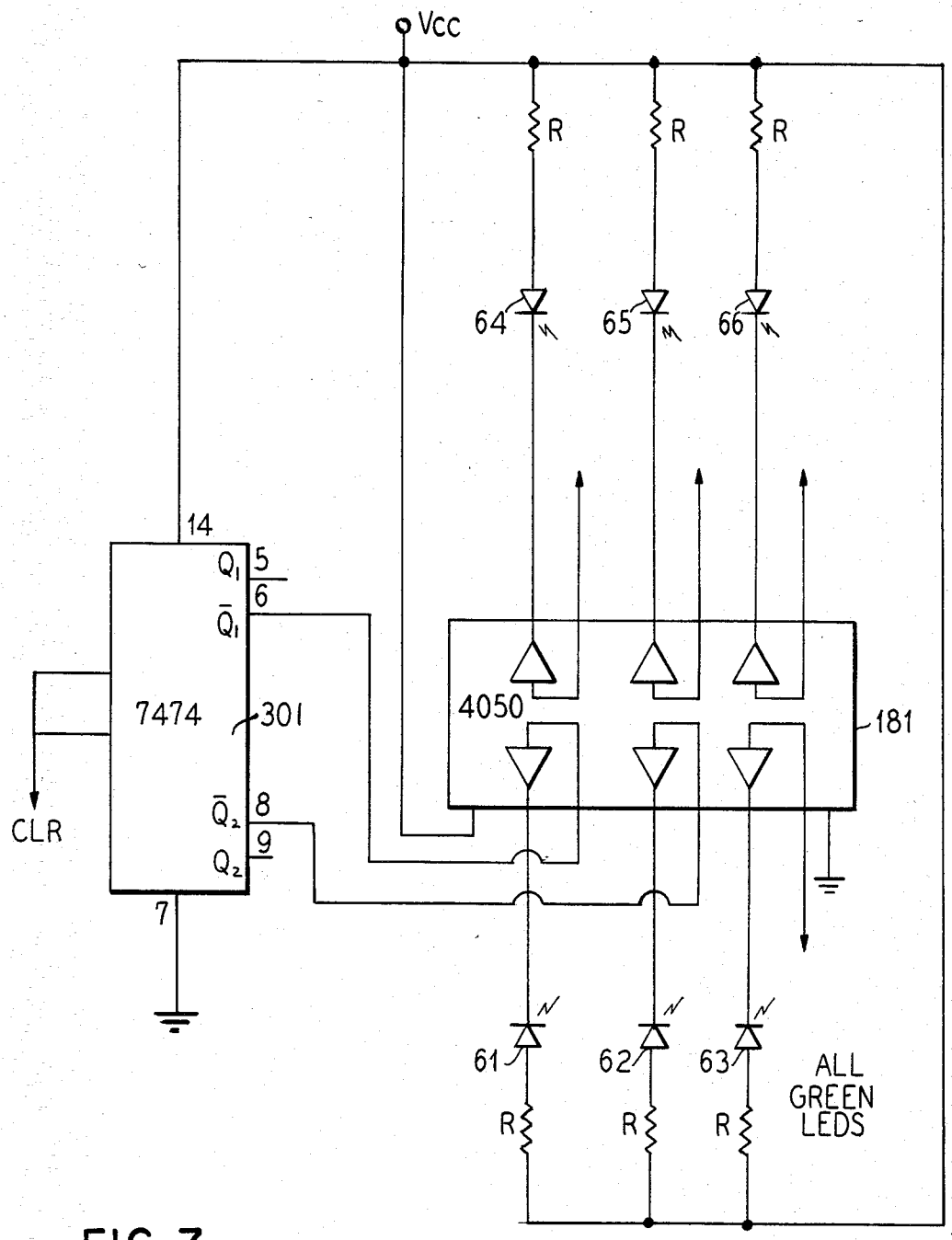
FIG. 7 is a schematic diagram for the lock out indicators which indicate when a dice has been selected for retention and retained by pressing the hold switch.

FIG. 7 illustrates the circuit for driving the lock out indicators 61 through 66 which are connected to an integrated circuit 301 which may be a type 7474 and a Hex non-inverting buffer 181 which may be a type 4050. Dropping resistors and green colored LED 61 through 66 can be used. When the roll circuit 150 is clocked out by switch 31, the NOT-Q or negative outputs of the IC7474 301 goes low activating the LEDs 61 through 66 for that particular lock out switch. Since these LEDs remain out at other times or when rolling dice or until the lock out selection is made and this is interlocked with the roll circuitry the associated die will be able to be rolled as long as the green lock out LED 61 through 66 is out and it cannot be rolled if the associated LED 61 through 66 is lighted.

Figure 8:
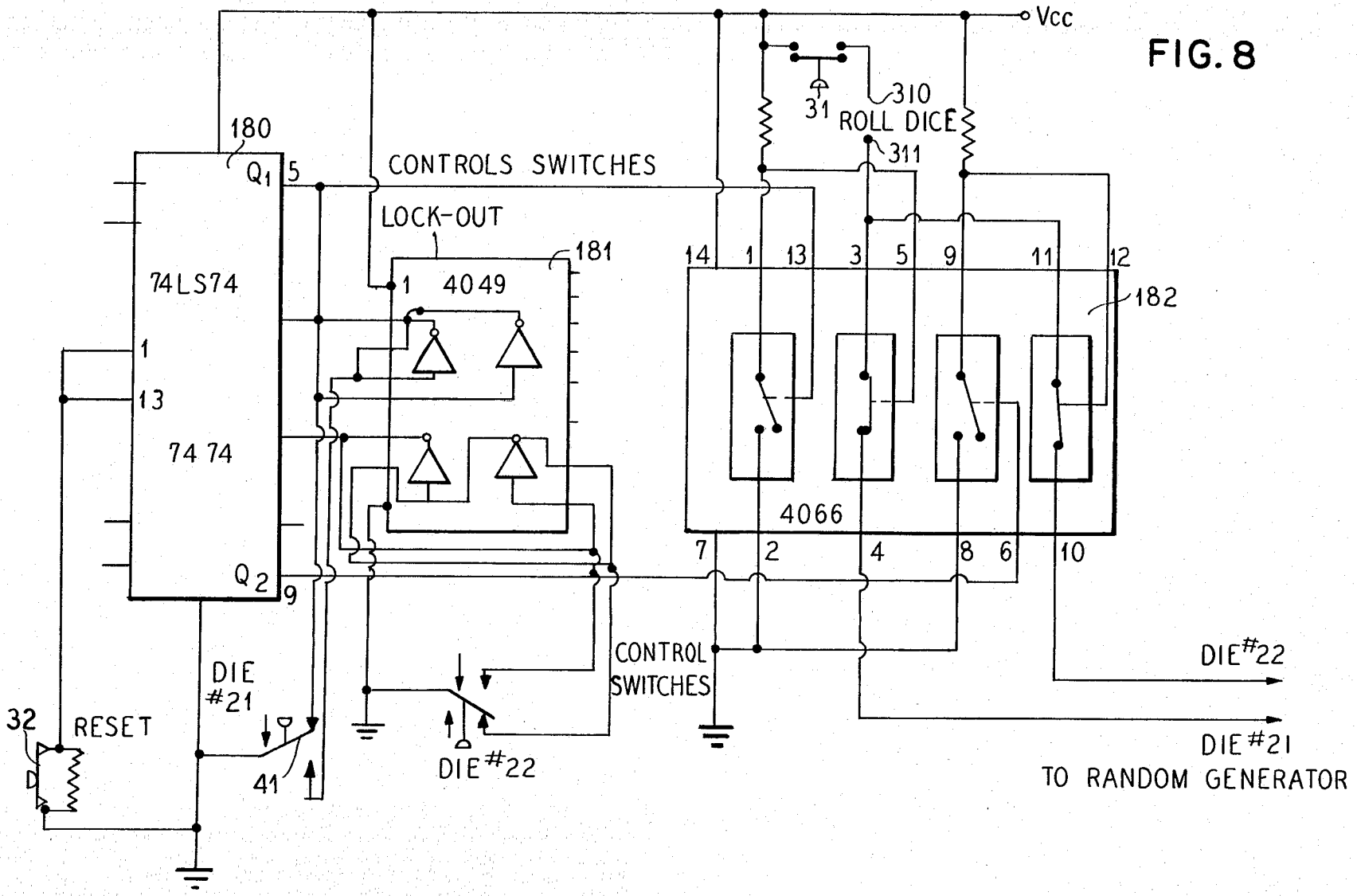
FIG. 8 is a schematic diagram for the dice rolling circuit and for retaining certain of the dice as selected by the player.

FIG. 8 illustrates the interlocking of the roll system. The integrated circuit 180 which can be a dual flip/flop type 7474 can be cleared by reset switch 32 which drops the inputs on pins 1 and 13 concurrently on each and all integrated circuits to ground. This places Vcc on pins 5 and 9 which are Q1 and Q2 at a value of Vcc which is supplied to integrated circuit 182 which may be a type 4066 quad bilateral analog switch connected so as to turn off the roll voltage normally coming through the contacts of the roll switch 31 and the resting closed circuit of the Vcc input pins of the integrated circuit type 555 timers on one of the random generators of which there are a total of ten circuits. It is to be noted that after the reset pin 4 and pin 10 of the 4066 Vcc voltage each time the dice are rolled by pressing the roll switch 31 unless contacts 310 and 311 are opened. The dice will then cycle rapidly through PIPS 1–6 and stop on one of these configurations when the roll dice switch 31 is released. This takes place only if the Q1 and Q2 outputs on the D flip-flop 180 is high at application of voltage Vcc. If however the lock out circuit is implemented by the type 4049 Hex inverter buffer integrated circuit 181 being locked out by lock out switch 41 the D flip-flop will flip and Q1 and Q2 will go low towards or near ground and pins 4 and 10 of the integrated circuit 182 type 4066 will open and that particular dice will no longer be rolled. The rest of the dice not locked out will behave normally and can be rolled by pressing the roll switch 31. It is necessary to make use of a bounce-free switch which is implemented by two sections of the quad type 4049 integrated circuit 181. Once locked out, the 7474 integrated circuit 180 will stay at ground on Q1 and Q2 until the reset 32 is pressed.

Figures 9, 9A:
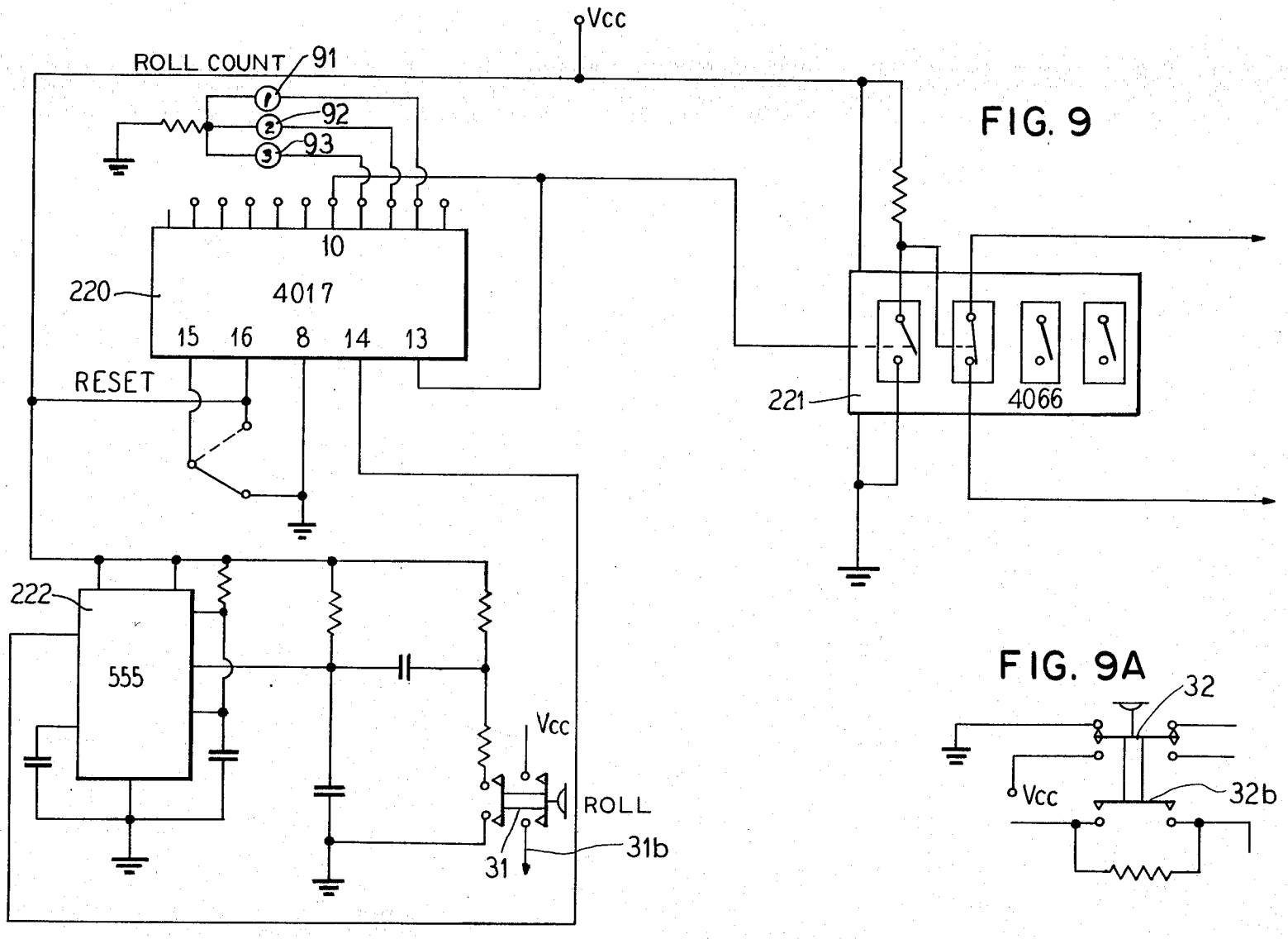
FIG. 9 is a schematic view illustrating the roll interrupt counter which controls the number of rolls, and indicates the rolls.
FIG. 9A is a circuit diagram showing the details of the reset switch.

FIG. 9 illustrates a part of the circuitry for the refinement of the overall system which makes use of an integrated circuit to provide a roll interrupt circuit coupled to a series of indicators showing the roll count to prevent the use of an illegal number of rolls that is more than the particular game in use allows. Coupled to the roll switch 31 through resistors and capacitors shown is another type 555 integrated timer circuit 222 which has a different configuration than the other 555 circuits and is designed to provide a single ten millisecond pulse each time the roll switch 31 is depressed. This is done by using a separate section on the roll switch. The single pulse from the 555 pulse generator 222 is supplied to a type 4017 counter/divider integrated chip type 4017, number 220 in a count and hold circuit. It has a "X" limit as to the count permitted may be set from 0 to 9 by simple circuit changes. In the invention, a count of three was chosen and when the game is activated none of the indicators 91, 92 or 93 are lighted. When the roll switch 31 has once been depressed signifying one roll, than light 91 will be illuminated. When the roll button 31 has been pressed a second time, the dice will roll and the indicator 92 will be lighted. When the roll switch 31 is pressed a third time, the dice will roll and the light 93 will be lighted. If the roll switch 31 is pressed again, the dice will not roll and all the lights 91, 92 and 93 will go out.

Since after the third roll, the close out voltage generated at pin 10 of the integrated circuit 220 will open the contacts of the adjacent 4066 decade counter/divider integrated circuit type 4066 across contacts 310 and 311 shown in FIG. 8. This circuit prevents any more transfer of energy for rolling through the 4066s to the random generators. When the reset switch is pressed for other circuitry, a separate section on switch 31 resets 220 the 4017 decade counter/divider by dropping it back to zero for the next player and game.

If the game of Craps is played, the roll counter and interrupt circuitry is bypassed since an unlimited number of rolls is permitted in Craps until certain external events take place. All other games in the present invention permit only three rolls and hence this is the present setting. It is to be realized of course that other number of rolls can be set. It is to be noted that if a player tries to take a fourth roll all the counter lights go out indicating that he has attempted to cheat.

Figure 10:
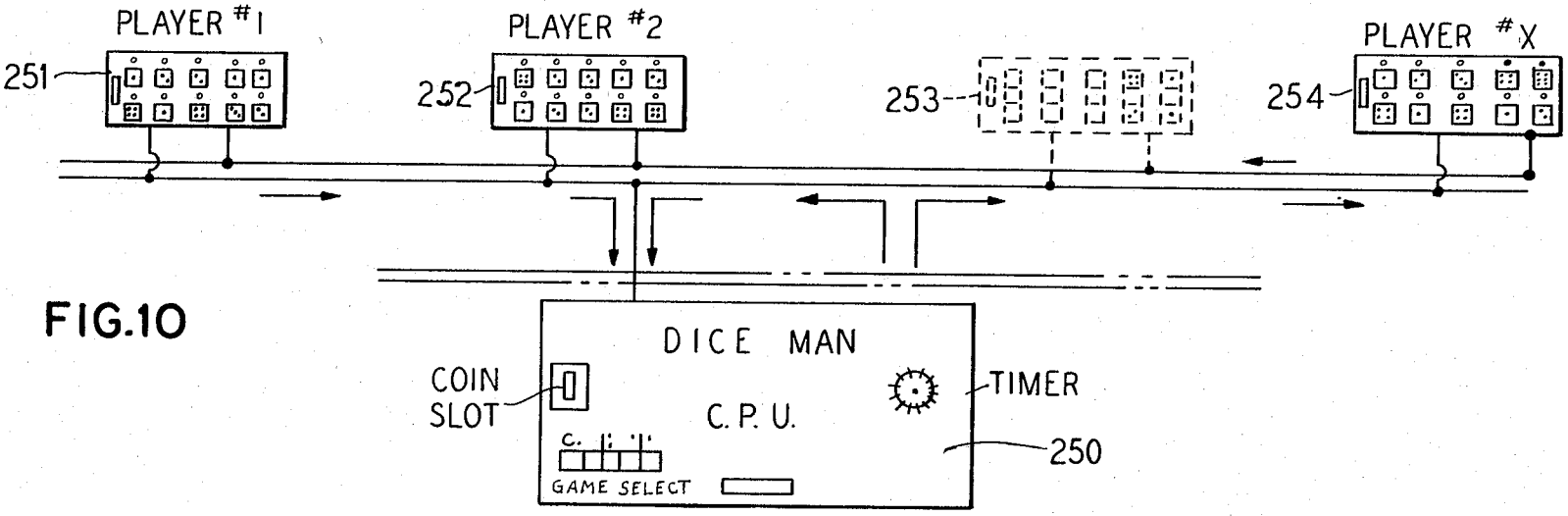
FIG. 10 is an overall schematic view illustrating use of a central computer unit.

FIG. 10 illustrates a possible configuration of the invention where a central computer unit 250 is connected to units 251 through 254 for different players so that they might play.

Figure 11:
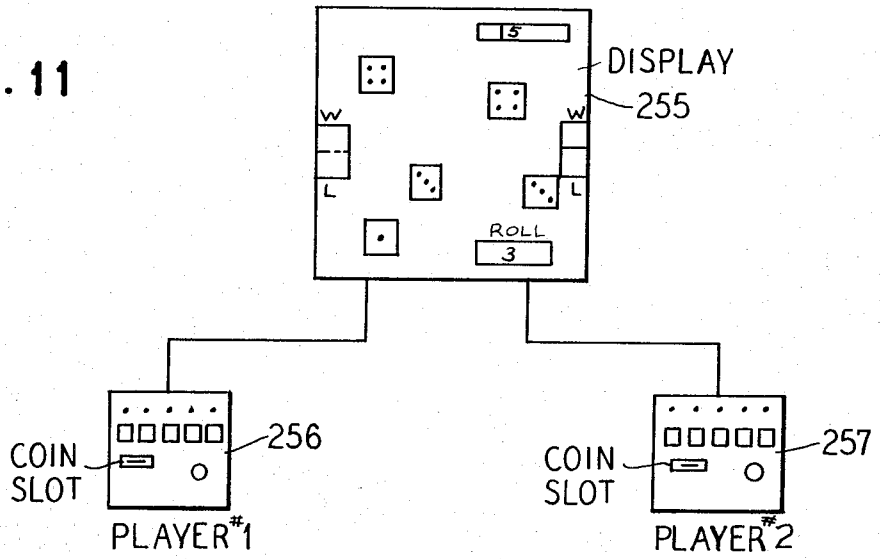
FIG. 11 illustrates a layout for use in an arcade or a home video game.

FIG. 11 illustrates a video presentation display 255 which is connected to player consoles 256 and 257.

There are many games which can be played on Dice Man, such as "Craps", "Hi-Lo", "Ship-Captain-Crew", "Poker" or "Liars Dice". Once the Dice Man box is set to the selected game the lights will be lighted properly for that game, and the roll counter preset accordingly. All that is then needed is to proceed with the game according to its "Rules of Play".

RULES OF PLAY

CRAP

As many players as wish may play at once but one player is the Shooter "who is selected" each player rolling two dice for high point. The one with the highest point plays first, and the ROLL advances around clockwise from him after he has lost it, and in order.

The shooter then places some sum of money in front of him and announces the amount. This is his Center bet and each other player is invited to Fade it, or any part of it. The players may share it amongst them. The shooter is betting to win and the faders are betting he will lose.

The shooter then presses the ROLL button and releases it when he is satisfied that the dice are ROLLED enough. Two dice will be lit with a number from One to Six. This is the Shooter's POINT.

If Seven or Eleven appears on the first ROLL, the Shooter wins. If Two (snake-eyes), or Three (Craps), or Twelve (again Craps), appears the Shooter loses. The Shooter retains the Roll, however, in both the above 3 cases, settles his bets and continues to roll again. POINTS-IF the Shooter's first number with two dice that appear is Four, Five, Six, Eight, Nine or Ten the bets are not settled and the Shooter must roll again to settle the bet.

If on the ROLL the Shooter gets the same point before he gets a Seven, he wins, collects his bet and puts out another new bet, and proceeds as before.

If he ROLLS a Seven before he rolls his point, the Shooter loses and his opponents collect the bet and the next Player on the left accepts the Roll and places his bet, etc.

If the current Shooter choses after his roll of a winner he may settle his bets and voluntarily pass the Roll to the next player.

When the Shooter wins it is known as a PASS; when he loses it is known as a MISS.

POKER DICE

Any number may Play, each having one turn. The Dice are ROLLED by pushing the ROLL button. In his turn the player may roll the dice once, twice or three times. His object is to get the best possible poker hand. The hands rank: Five of a kind (high), four of a kind, full house (three of a kind and a pair), three of a kind, high straight (two to six), low straight (Ace, now counted as one-to five), two pair, one pair, high card. Ties are broken by Rolling again, after an additional bet is placed in the pot. (Center of table).

After his first ROLL (pushing the Roll button) player may Lock-out any of the five dice displayed by pushing the Lockout button under the dice. A green lite will come on showing that that number is Locked-out and it will not Roll again when the roll button is pushed.

After his second Roll the Player may do as above; i.e. select one or more dice to be held by pushing the lock-out button under the dice so chosen. The third roll determines his final hand, and all numbers should be locked-out. The roll counter will go out if the roll button is pushed for the fourth time but no dice will roll after the third roll is taken.

After any roll (first, second et al) the Player may choose to stay on the count shown-"Stick with these", and he should lock-out all dice. There is no penalty or Bonus for making a selected hand in one or two rolls.

The highest hand wins, in accordance with the above ranking of hands. If hands tie each of the players of these hands rolls again but not the non-tiers, one ranks as an acehigh for all hands except a low straight where it counts as a one.

HIGH-LOW (Hi-Lo)

Five dice are used, and any number may play. Each player in turn has a maximum of five rolls. From each roll, he must keep at least one die, which he does by locking-out that die by pushing the button underneath that die. He may, of course, keep as many as he chooses or he may roll the remaining dice again, up to a total of three rolls. At each roll the roll counter will change from a Yellow to Green to Red and on the fourth will go out, but it will not roll after the third roll, i.e. only three rolls may be taken. After the first roll the roller decides to "GO HIGH" or "Go for Low" and must stick with this decision.

After any roll the Player may stick with his roll and announce to the other players, after locking out the dice (all five), that he made "x x x" in one roll or two rolls, or "all the way" three rolls. The roll then passes to the next player, and he tries to beat the first player's high or low score in the same number of rolls. E.G. If the first player made 29 in two rolls, the second player must make more than 29 in two rolls to win. If the first player announces "going for low" and makes 14 in one roll the second player must make less than 14 in one roll.

The roller may stand at any time on any count and announce it to the other players for bettering.

If any two players tie, they play another game amongst themselves to determine the winner. In this game, Hi-Lo dice is played with five (5) dice.

LIAR'S DICE

In Liar's Dice as in Poker, it is possible for the inferior hand to win. In fact of all the dice games based on Poker hands this is the only one that allows for play comparable with the card game.

Two players play, having five dice and a separate dice man cassette each. These are interconnected via hard wire to a central computer, which "deals" out the dice and keeps score; as well as several other things. Neither player should be able to see the other's dice man cassette.

After each roll the entire five dice are read as a Poker hand on the bottom series of dies in the hand held cassette of the roller. Ace ranking high-above the six, in every combination except straights where it always ranks below the two (deuce). The rank of hands are: five of a kind (high), four of a kind; full house; high straight (6 high); low straight (5 high); three of a kind; two pair; one pair; high card.

To begin a game, each player presses the roll button and counts the total of his PIPS (as in Hi-Lo). The highest number of points wins and rolls first. He is then the "caller". The winner of each roll becomes the caller and rolls first, in the next game. A game is two of three "deals", or four or as agreed upon including a single "deal".

To begin a "deal" both players press the roll button and when satisfied that the roll is long enough (the dice have been shaken enough) lets it go and a series of five dice numbers will appear on the lower set of dice. The caller may then say he is satisfied by pressing the "OK" button which will light a green lite on his opponents cassette. If the white light lights on the opponents cassette the opponent may elect the same alternate. If either one is satisfied the "deal" is played out. If both are dissatisfied, which will be shown by a red light instead of a green "go ahead lite", the cassette is reset by pushing the replay button. The caller may pass the buck by saying "either way" by pushing the No Choice button which will light a yellow lite on the opponents cassette. The opponent may then decide to play or not and pushes the "Go Ahead" button or the Replay button as desired.

When the first roll stands, the caller must announce his (supposed) hand, which must first be indexted in by pushing the separate buttons above upper dies in turn, i.e. number one dice, Number two dice, etc. These will slowly roll from 1 to 6 and when the die desired is gotten the roll button should be released and the "Lock-out" button under that dice pressed. This will "preserve" that selection. The next dice is then selected in a similar manner until all five dice are chosen to make up the hand desired; e.g. four aces, full house, two pair, et al.

Once the real hand is chosen and the LIAR's hand selected in and all are locked-out the "Display hand" is pressed and the Liar's Hand, the top row of dice will appear on the opponents cassette but not the real hand. The central computer will also record the twohands, into memory.

The Cardinal Rule of the Game is that a player may announce any hand he pleases, regardless of what his roll actually is. He does this by choosing 5 die in the top row and locking these in and transmitting them to his opponent.

In reply to any such announcement the other player (the opponent) must do one of two things: push the Liar button on his cassette or (2) announce a higher hand.

The act of pushing the Liar button is saying "I don't believe you and I call your bluff. If he has a as good or better then announced the player who called "Liar" loses, but if it is inferior, he loses.

Each player is entitled, after his first roll, to make two additional rolls, of some or all of his dice. For example, having rolled 4, 4, 2, 5, 6 he may save the pair of 4's by pressing the lock-out underneath those two dice, and roll the other three dice by pressing the roll button again, and so on. At the end of three rolls the count lites will go blank and no more rolls will be possible (the roll button is disabled). If on the second roll the player gets another four he may lock it out and roll the last two dice to try to better his "hand".

If the second player, when he receives his possible Liar's hand does not at once press the Liar button he must call a high hand, but before he does so he is entitled to make one or both of his additional rolls (Having done so he may not change his mind and declare Liar by pushing the Liar button).

SHIP, CAPTAIN CREW

Ship, Captain, Crew is played with the five dice array, which will automatically light when the Cassette is set to Ship, Captain, Crew. The roll button is pressed and five different die will lite on various numbers. The player must get a 6 before a five or four or any other number. This is the SHIP. If no ship is gotton on the first roll the dice must be rolled again and again (up to a maximum of three times when the cassette will automatically lock-out). Once a 6 is achieved, the player must get a Five which is the Captain. Then one may try for a 4. Once the Ship, Captain, Crew is gotten and locked out any remaining dies are counted at face value and the amount is called the CARGO. The highest amount of Cargo wins, but first one must have a ship, to have a Captain, to have a crew, to have some Cargo.

If on the first or second roll, ship, and a captain, or even a ship, a captain, and a crew is achieved, the player may lock these out and call off the amount of his cargo, or choose to roll the second or third time to get more cargo. He must have his 6,5 and 4 at all times before counting Cargo.

If the first player (the Caller and winner of the last game) gets a good hand in one roll, or in two, he announces "Cargo of seven" or "Cargo of 3, in one roll" or "Cargo of three in two rolls", and the second and all the following rollers must beat his score in the same number of rolls. The best hand would be three sixes a five and a four, since this would give the SHIP, THE CAPTAIN, CREW plus a cargo of 12 in one roll.

Although the invention has been described with respect to preferred embodiments, it is not to be so limited as changes and modifications can be made which are within the full intended scope of the invention as defined by the appended claims.

I claim as my invention:

1. An electronic dice game comprising a first console with a first die which has at least seven PIP indicators, a first random voltage generator which generates random voltages with a plurality of outputs connected to said seven PIP indicators, and a roll switch connected to said first random voltage generator to energize it when said roll switch is actuated, wherein said roll switch causes said seven PIP indicators to be randomly illuminated to different indications when it is depressed and some of said seven PIP indicators continue to be illuminated when said roll switch is released, including at least a second die which has seven PIP indicators, a second random voltage generator with a plurality of outputs connected to said seven PIP indicators of said second die, and said roll switch connected to said second random generator to energize it when said switch is actuated, including eight additional dice each of which have seven PIP indicators, third through tenth random voltage generators each with a plurality of outputs respectively connected to said seven PIP indicators of said third through tenth PIP indicators and said roll switch connected to said third through tenth random generators to energize them when said switch is actuated, including one or more lock out switches connected to one or more of said dice so that when a selected lock out switch is depressed the associated die does not change its indication at least the next time the roll switch is actuated, including a roll indicator connected to said roll switch to indicate the number of rolls during a single game, comprising a roll counter means connected to said roll switch to count the number of rolls after reset and to prevent additional rolls after the authorized number have been rolled, and wherein said first random voltage generator comprises a plurality of flip-flop circuits at least one of which is connected to said roll switch, and a plurality of gates connected between said flip-flop circuits and said PIP indicators, a second console similar to said first console, a game selector switch on said first or second console to allow particular games to be selected such that said game selector switch controls said roll indicator and said roll counter so that the conditions for the selected game are set.

2. An electronic dice game according to claim 1 wherein a central computer unit is connected to said first and second consoles and said game selector switch and is programmed so as to establish the conditions for the game which has been selected by said game selector switch.

* * * * *